US006848410B2

(12) United States Patent
Hoffmann et al.

(10) Patent No.: US 6,848,410 B2
(45) Date of Patent: Feb. 1, 2005

(54) SOUND TRANSMISSION DEVICE FOR A MOTOR VEHICLE

(75) Inventors: Reinhard Hoffmann, München (DE); Kay Brodesser, Rutesheim (DE); Udo Lindner, Karlsfeld (DE)

(73) Assignees: Mahle Filtersysteme GmbH, Stuttgart (DE); Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 10/472,710

(22) PCT Filed: Mar. 22, 2002

(86) PCT No.: PCT/DE02/01045

§ 371 (c)(1),
(2), (4) Date: Sep. 19, 2003

(87) PCT Pub. No.: WO02/077969

PCT Pub. Date: Oct. 3, 2002

(65) Prior Publication Data

US 2004/0094112 A1 May 20, 2004

(30) Foreign Application Priority Data

Mar. 23, 2001 (DE) ..... 101 14 397

(51) Int. Cl.[7] ..... G10K 11/22
(52) U.S. Cl. ..... 123/184.57; 181/204
(58) Field of Search ..... 123/184.57; 181/204; 340/384.1

(56) References Cited

U.S. PATENT DOCUMENTS

| | | | | | |
|---|---|---|---|---|---|
| 5,628,287 | A | * | 5/1997 | Brackett et al. | 123/184.55 |
| 6,155,224 | A | * | 12/2000 | Akihisa et al. | 123/184.57 |
| 6,450,141 | B1 | * | 9/2002 | Sakuma | 123/184.57 |
| 6,600,408 | B1 | * | 7/2003 | Walter et al. | 340/384.1 |

FOREIGN PATENT DOCUMENTS

| | | |
|---|---|---|
| DE | 4435296 | 4/1996 |
| DE | 19922216 | 11/2000 |
| DE | 10016104 | 10/2001 |
| EP | 1138887 | 10/2001 |
| GB | 2354986 | 4/2001 |
| JP | 02248610 | 12/1990 |
| WO | WO0004532 | 1/2000 |

* cited by examiner

*Primary Examiner*—Marguerite McMahon
(74) *Attorney, Agent, or Firm*—Collard & Roe, P.C.

(57) ABSTRACT

A device for the targeted sound transmission from an intake tract of an internal combustion engine to the interior of a motor vehicle. The device comprises at least one hollow transmission conduit, which communicates on the input side with the intake tract and to which at least one resonator chamber, which emits the sound to the motor vehicle interior, is connected. In order to achieve improved modulation of the sound that is emmitted to the motor vehicle interior, the inventive device has several resonator chambers operating in parallel, at least two of which differ from one another with respect to the tuning of their frequencies.

17 Claims, 3 Drawing Sheets

SOUND TRANSMISSION DEVICE FOR A MOTOR VEHICLE

Figure 1:
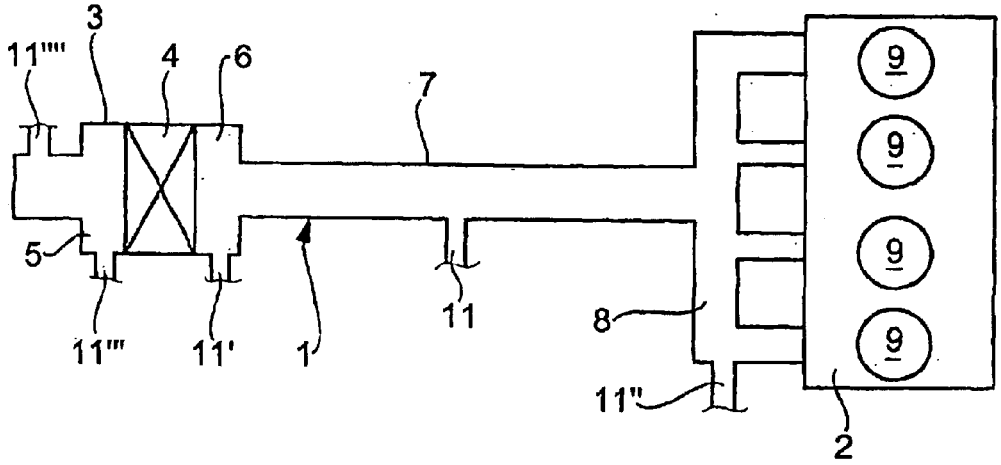

Applicants claim priority under 35 U.S.C. §119 of GERMAN Application No. 101 14 397.4 filed on Mar. 23, 2001. Applicants also claim priority under 35 U.S.C. §365 of PCT/DE02/01045 filed on Mar. 22, 2002. The international application under PCT article 21(2) was not published in English.

The present invention relates to a device for targeted noise transmission from an intake tract of an internal combustion engine of a motor vehicle, particularly a passenger motor vehicle, to an interior space of the motor vehicle, having the features of the preamble of claim 1.

A noise transmission device of this type is known, for example, from German Patent Application 199 22 216 A1 and has a hollow transmission line which is connected on the input side to communicate with the intake tract of the internal combustion engine and to which a resonator chamber is attached. This resonator chamber is tuned to a specific frequency or a specific frequency band and is aligned in this case so that it emits a noise fed via the transmission line to the vehicle interior space.

It has been shown that with the aid of the known noise transmission device, only an insufficient noise effect and/or sound may be achieved in the vehicle interior space for specific internal combustion engines and/or for specific vehicles. The possibilities for targeted generation of a desired sound in the vehicle interior space are relatively restricted for the known noise transmission device.

The present invention is concerned with the object of specifying an embodiment for a noise transmission device of the type initially cited in which the possibility of targeted generation of a desired noise effect or sound in the vehicle interior space is improved.

This object is achieved according to the present invention in that multiple resonator chambers acting in parallel are provided, at least two of which differ from one another in regard to their frequency tuning. The present invention uses the knowledge in this case that the noise transmission system of the device according to the present invention operates using resonances, resonance effects typically arising only in relatively narrow frequency ranges. By providing multiple resonator chambers, multiple different resonance frequencies may therefore be exploited in order to generate the desired noise effect. Through multiple different resonator chambers, various frequencies of the noise generated by the internal combustion engine may be amplified in a targeted way in order to produce the desired noise impression in the vehicle interior space.

In a refinement, the noise transmission paths from the intake tract to the individual resonator chambers may be implemented as half-wave resonators or have a section implemented as a half-wave resonator, at least two of the half-wave resonators differing from one another in regard to their frequency tuning. Through these measures, a half-wave resonator is connected upstream from each resonator chamber, through which additional frequency amplification may be achieved. In this case, different resonance frequencies may be set through different lengths of the noise transmission paths.

In another refinement, each resonator chamber may be assigned a membrane which is excited to oscillation by the noise supplied. At least one of the membranes in the associated resonator chamber expediently separates an input-side first space from an output-side second space. In this case, the first space forms a "Helmholtz resonator", whose characteristic may be influenced by the volume of the second space.

In an advantageous refinement, at least two of the membranes may differ from one another in regard to their frequency tuning. Correspondingly, manifold possibilities result for frequency tuning of the individual resonator chambers.

In a separate embodiment, switching means may be provided, using which the individual resonator chambers are activatable and deactivatable. Through this construction, it is possible to switch individual resonator chambers on and off. In particular, the individual resonator chambers may thus be activated one after another, so that only one resonator chamber is activated at a time, while all others are deactivated. It is also possible to activate multiple resonator chambers, particularly all of the resonator chambers. In this case, different combinations may be switched in order to generate different sound effects.

The noise transmission device according to the present invention is of special significance for an internal combustion engine which is equipped with a active intake system. The switching means for activating and/or deactivating the individual resonator chambers are preferably operated in such an internal combustion engine as a function of the particular switching state of the active intake system. In this way, changes of the noise emission characteristic of the internal combustion engine upon switching of the active intake system may be compensated for and/or influenced in such a way that a desired hearing impression results in the vehicle interior space in every switching state of the active intake system.

Further important features and advantages of the device according to the present invention result from the subclaims, the drawing, and the associated description of the figures on the basis of the drawing.

It is obvious that the features cited above and explained in the following are usable not only in the particular combination specified but also in other combinations or alone without leaving the scope of the present invention.

Preferred exemplary embodiments of the present invention are shown in the drawing and will be described in greater detail in the following description.

Figure 2:
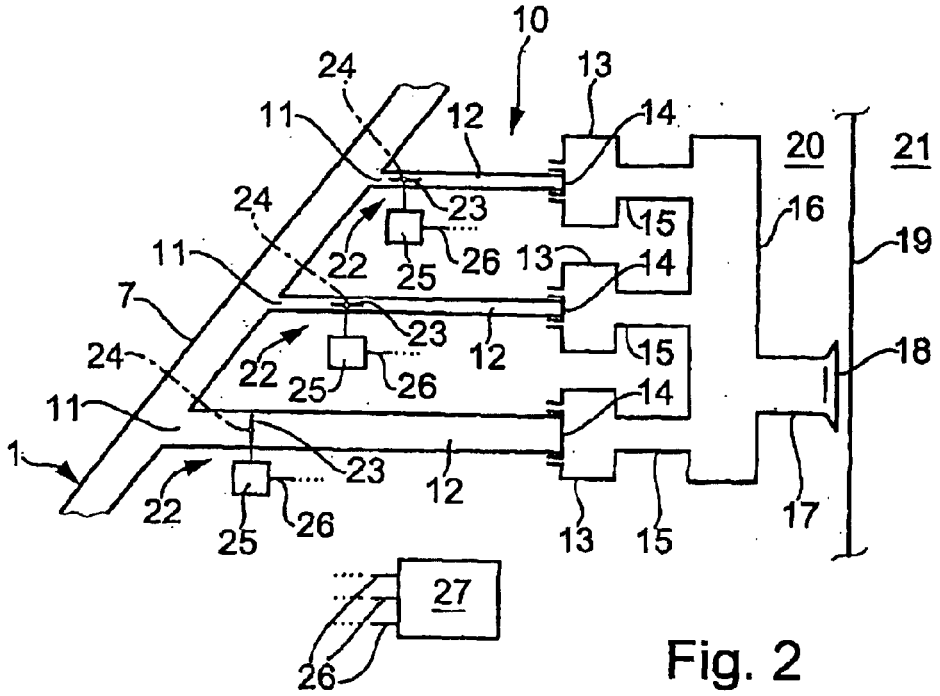
Figure 3:
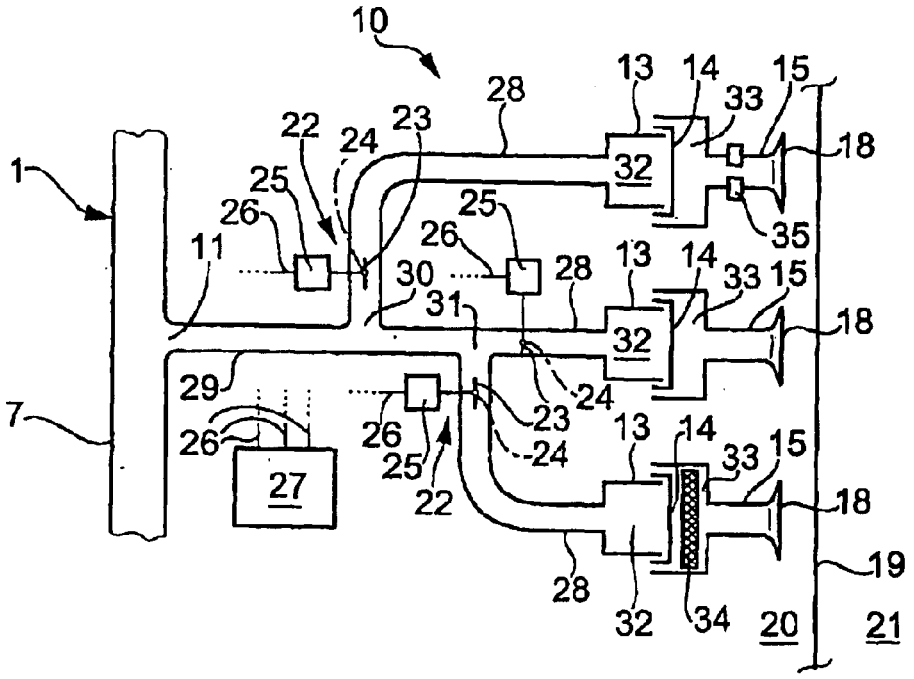
Figure 4:
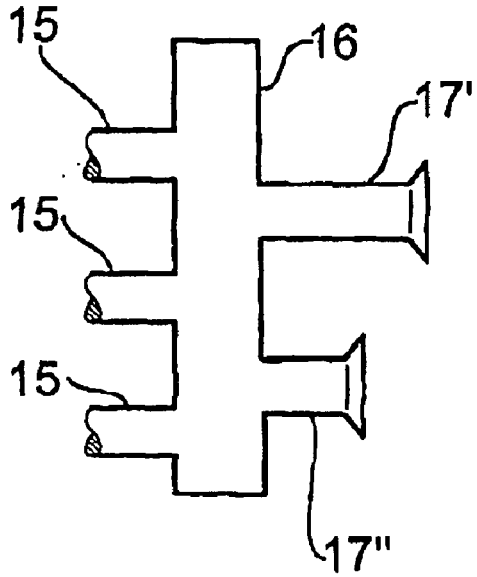
Figure 5:
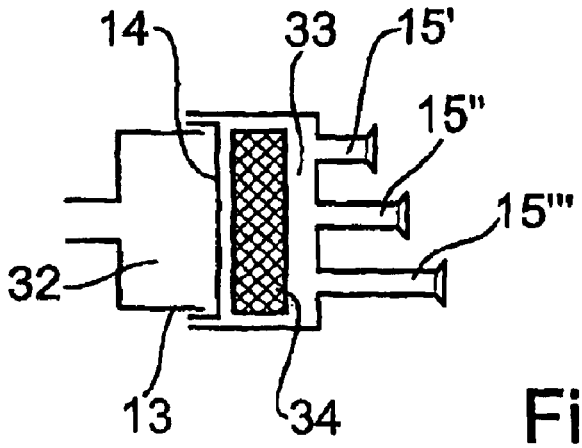

FIG. 1 shows a schematic illustration of an intake tract of an internal combustion engine, FIG. 2 shows a schematic illustration of a first embodiment of a noise transmission device according to the present invention, FIG. 3 shows a schematic illustration of a second embodiment of the noise transmission device according to the present invention, FIG. 4 shows a schematic illustration of a separate design of the embodiment shown in FIG. 2, and FIG. 5 shows a schematic illustration of a separate design of the embodiment shown in FIG. 3.

As shown in FIG. 1, an air intake tract 1 of an internal combustion engine 2 has an air filter 3, in which a filter element 4 separates an unfiltered side 5 from a filter side 6. A connecting line 7, which may be formed by a pipe, for example, connects the air filter 3 to an air header 8, which distributes the fresh air sucked in to individual cylinders 9 of the internal combustion engine 2. Within this air intake tract 1, a noise field is implemented during operation of the internal combustion engine 2, whose tonal or noise characteristic is correlated with an output provided by the internal combustion engine 2, particularly with its speed. In order to provide acoustic feedback of the internal combustion engine activity to the vehicle occupants, above all the vehicle driver, the motor vehicle (otherwise not shown), which is particularly a passenger car, preferably a sports car, has a noise transmission device 10 as shown in FIGS. 2 and 3.

As shown in FIG. 1, an input side 11 of this noise transmission device 10 is preferably connected to the connecting line 7 of the intake tract 1. Embodiments are also possible in which the input side 11' is connected to the filtered side 6 of the air filter 3. In many vehicle types, it may be advantageous to connect the input side 11" to the air header 8. In another embodiment, the input side 11''' may be connected to the unfiltered side 5 of the air filter 3. It is also possible to connect the input side 11"" to the unfiltered side of the intake tract 1, upstream of the air filter 3. For the embodiments in which the noise transmission device 10 communicates with the filtered side of the air intake tract 1, care must be taken that the noise transmission device 10 is implemented as airtight to the outside.

As shown in FIG. 2, the noise transmission device 10 according to the present invention has, for example, three hollow transmission lines 12, which are attached to the connecting line 7 relatively closely next one another here.

It is also possible for the different transmission lines 12 to be attached to different points on the intake tract 1.

For this purpose, reference is made to the attachment possibilities of the input side 11 to 11"" listed above as examples.

Each transmission line 12 leads to a resonator chamber 13. Each resonator chamber 13 is separated gas-tight at the input side from the associated transmission lines 12 via a membrane 14 and is connected on the output side to an outlet pipe 15. In the embodiment shown here, all outlet pipes 15 are connected to a joint header 16, which has a joint noise outlet pipe 17 for all of the resonator chambers 13, which is equipped here with a funnel-shaped outlet 18. This outlet 18 is positioned frontally in front of a separating wall 19, the "bulkhead", which separates an engine compartment 20 from a vehicle interior space 21. Correspondingly, the noise transmission occurs through this separating wall 19. It is also possible to implement the noise outlet 18 in the separating wall 19 and/or to lead the noise outlet pipe 17 through the separating wall 19, in order to thus position the noise outlet 18 directly in the vehicle interior space 21.

Each transmission line 10, together with the associated resonator chamber 13 and the associated membrane 14, forms a noise transmission system, so that in the exemplary embodiment shown in FIG. 2, there are three such noise transmission systems, which may be active simultaneously or in parallel. Embodiments having more or less noise transmission systems are also possible. The individual noise transmission systems are preferably tuned to different frequencies in order to thus implement a desired broadband effect for the noise transmission device. At least two of the resonator chambers 13 are accordingly implemented differently from one another in regard to their frequency tuning. For example, they differ in regard to their volume. In addition, the individual membranes 14 may also be implemented differently from one another in regard to their frequency tuning. For example, the individual membranes may differ from one another in regard to their diameter. Furthermore, different materials, different thicknesses, and mass configurations may be selected. Furthermore, the individual transmission lines 12 may differ from one another in regard to their diameter and/or their length, for example.

An embodiment in which at least one of the transmission lines 12 is implemented as a "half-wave resonator" is especially advantageous. If multiple transmission lines 12 are implemented as half-wave resonators, they may be implemented for different resonance frequencies.

FIG. 2 shows a preferred embodiment in which the noise transmission device 10 according to the present invention has switching means 22, using which the individual noise transmission systems and/or the individual resonator chambers 13 may be activated and deactivated. The switching means 22 have a flap 23 in each transmission line 12 in this case, each of which may be adjusted by pivoting it around a pivot axis 24 running perpendicular to the plane of the drawing. Furthermore, actuators 25 are provided, each of which drives one of the flaps 23 for adjustment. The individual actuators 25 are connected in this case via a corresponding control lines 26 to a controller 27, which operates the individual actuators 25 as a function of predetermined parameters.

As shown in FIG. 3, in another embodiment of the noise transmission device 10 according to the present invention, each resonator chamber 13 is connected via a separate connection line 28 to a joint transmission line 29, whose input side 11 is in turn connected to the intake tract 1, to the air line 7 in this case. As shown here, the individual connection lines 28 may be connected to different points 30 and 31 on the shared transmission line 29. It is also possible for all connection lines 28 to branch off and/or originate from approximately the same point on the joint transmission line 29.

The individual connection lines 28 may differ from one another, preferably in regard to their diameter and/or their length. The connection lines 28 may also be implemented as half-wave resonators.

In the embodiment shown in FIG. 3 as well, the individual connection lines 28 and/or the resonator chambers 13 coupled thereto are implemented as switchable, i.e., switching means 22 having flap 23 and actuator 25 are provided.

By operating the actuators 25, the flaps 23 may be pivoted in order to open the cross-section of the transmission line 12 (in the example shown in FIG. 2) or of the connection line 28 (in the example shown in FIG. 3) to activate the particular resonator chamber 13 and to close them to deactivate the particular resonator chamber 13.

Accordingly, in FIG. 2 the upper and the middle resonator chambers 13 are activated, while the lower resonator chamber 13 is deactivated. In contrast, in the embodiment shown in FIG. 3, the upper and the lower resonator chambers 13 are activated, while the middle resonator chamber 13 is deactivated.

The resonator chambers 13 shown in FIG. 3 differ from those of FIG. 2 in the arrangement of the membranes 14. In FIG. 3, the membranes are positioned inside the resonator chambers 13 in such a way that the membrane 14 separates an input-side first space 32 from an output-side second space 33. In this case, the particular first space 32 forms a "Helmholtz resonator". As already explained in regard to FIG. 2 above, the individual resonator chambers 13 may be implemented differently from one another in regard to their frequency tuning, the individual noise transmission systems able to differ from one another in regard to the design of the connection lines 28 and the volumes of the resonator chambers 13. The membranes 14 may also be implemented differently from one another. In the embodiment shown in FIG. 3, different frequency tunings may also result through variation of the size of the first space 32 and/or the second space 33.

In order to change the noise emission characteristic of the resonator chambers 13, a damping body 34 may be used in the second chamber 33, for example, which is made as an open-pore foam, for example. It is also possible to house a damping material of this type in the particular outlet pipe 15 or even in the first space 32 or in the connection line 28. For example, this damping body 34 is only used in the lower noise transmission system in FIG. 3. A damping material of this type or another damping material may also be positioned in the other noise transmission systems.

A screen 35 is also positioned in the noise outlet pipe 17 of the upper noise transmission system, for example, whose screen cross-section is smaller than the pipe cross-section of the outlet pipe 15. By adjusting the screen cross-section, the acoustic behavior of the resonance system may also be varied.

In contrast to the embodiment shown in FIG. 2, in the variant shown in FIG. 3, a shared header 16 is not provided, rather each outlet pipe 15 has its own noise outlet 18; these are each positioned near the separating wall 19. It is also possible to position the noise outlets 18 in or beyond the separating wall 19 in this case.

Since the noise transmission device 10 according to the present invention is implemented to amplify different frequencies and/or frequency bands, relatively manifold design possibilities result for the generation and modulation of a desired engine sound in the vehicle interior space 21. In this case, the embodiment having switchable resonator chambers 13 is of special interest. The controller 27 may operate the switching means 22 as a function of the current operating state of the internal combustion engine 2 in this case, for example. At the same time, it is possible to activate and/or deactivate the resonator chambers 13 individually. In particular, two or more resonator chambers may be activated in parallel. All of the resonator chambers may also be activated or deactivated. In this case, it is possible in principle to design two of multiple noise transmission systems for the same frequency, only one of these noise transmission systems being active in a first operating point, while both noise transmission systems are activated in parallel in a second operating point in order to amplify the assigned frequency once again.

In an internal combustion engine 2 which is equipped with a active intake system, switching procedures occur as a function of the speed, using which the intake pipe lengths are changed to improve the charging behavior. These switching procedures are normally accompanied by a noise characteristic emitted by the internal combustion engine 2. In order to reduce disadvantageous effects of switching procedures of this type for noise generation in the vehicle interior space 21, in a preferred embodiment, the operation of the switching means 22 may be performed as a function of the switching states of this active intake system.

In the embodiment shown in FIG. 3, the connection lines 28 of the upper and lower noise transmission systems are connected to the joint transmission line 29 in such a way that they discharge essentially perpendicularly therein. In contrast to this, the connection line 28 of the middle noise transmission system represents a coaxial extension of the joint transmission line 29. In principle, however, other, particularly arbitrary, connection angles are possible.

Through the perpendicular connection, the connection lines 28 of the upper and lower noise transmission systems may each be implemented as half-wave resonators. Through the aligned arrangement of the connection line 28 of the middle noise transmission system, this connection line 28 may also form a half-wave resonator together with the joint transmission line 29.

As shown in FIG. 4, in a refinement of the device 10 shown in FIG. 2, the header 16 may be equipped, in a separate embodiment, with multiple, in this case two, joint outlet pipes 17' and 17", which differ from one another in regard to their dimensions. The spectrum of the noise frequencies emitted may also be influenced through this measure As shown in FIG. 5, in a refinement of the device 10 shown in FIG. 3, at least one of the resonator chambers 13 may be equipped with multiple, in this case 3, outlet pipes 15', 15", and 15'", which differ from one another in regard to their dimensions. In this case as well, the characteristic of the noise emitted may be influenced within a resonator chamber 13. In particular, an elevated bandwidth of the noise emitted results through the arrangement of multiple outlet pipes 15 and/or 17 (cf. FIG. 4).

What is claimed is:

1. A device for targeted noise transmission from, an intake tract (1) of an internal combustion engine (2) of a motor vehicle to an interior space (21) of the motor vehicle, having at least one hollow transmission line (12; 29), which is connected on the input side to communicate with the intake tract (1) and to which at least one resonator chamber (13) is connected, which emits the noise to the vehicle interior space (21), characterized in that multiple resonator chambers (13), which act in parallel, are provided, at least two of which differ from one another in regard to their frequency tuning.

2. The device according to claim 1, characterized in that each resonator chamber (13) is connected to the intake tract (1) via a separate transmission line (12).

3. The device according to claim 1, characterized in that all resonator chambers (13) are connected to the intake tract (1) via a joint transmission line (29) in such a way that each resonator chamber (13) is connected via a separate connection line (28) to the shared transmission line (29).

4. The device according to claim 3, characterized in that the connection lines (28) are connected to different points (30, 31) on the joint transmission line (29).

5. The device according to claim 1 characterized in that the noise transmission paths from the intake tract (1) to the resonator chambers (13) are implemented as half-wave resonators or have a section implemented as a half-wave resonator, at least two of the half-wave resonators differing from one another in regard to their frequency tuning.

6. The device according to claim 3, characterized in that at least one of the connection lines (28) is implemented as a half-wave resonator.

7. The device according to claim 3, characterized in that at least one of the connection lines (28) is implemented together with the joint transmission line (29) as a half-wave resonator.

8. The device according claim 1, characterized in that each resonator chamber (13) is assigned a membrane (14).

9. The device according to claim 8, characterized in that at least one of the membranes (14) separates an input-side first space (32) from an output-side second space (33) in the associated resonator chamber (13).

10. The device according to claim 8, characterized in that at least two of the membranes (14) differ from one another in regard to their frequency tuning.

11. The device according to claim 1, characterized in that the resonator chambers (13) are connected on the output side to a joint header (16), via which the resonator chambers (13) emit the noise to the vehicle interior space (21).

12. The device according to claim 1, characterized in that switching means (22) are provided, using which at least one of the resonator chambers (13) may be activated and deactivated.

13. The device according to claim 12, characterized in that the switching means (22) for switching a resonator chamber (13) have a flap (23), which opens the cross-section of the associated transmission line (12) or connection line (28) for activation and closes it for deactivation.

14. The device according to claim 12, characterized in that the switching means (22) switch on, switch off, and connect the resonator chambers (13) as a function of the operating state of the internal combustion engine (12).

15. The device according to claim 12, characterized in that the switching means (22), in an internal combustion engine (2) which is equipped with a active intake system, switch on, switch off, and connect the resonator chambers (13) as a function of the switching state of the active intake system.

16. The device according to claim 1, characterized in that at least one of the resonator chambers (13) has multiple outlet pipes (15', 15", 15'") on the output side having different dimensions.

17. The device according to claim 11, characterized in that the header (16) has multiple joint outlet pipes (17', 17") having different dimensions.

* * * * *